United States Patent [19]

Darroch

[11] Patent Number: 4,854,822

[45] Date of Patent: Aug. 8, 1989

[54] SERIES IMPELLER AIR PUMP FOR LIQUID SPRAYER

[75] Inventor: John B. Darroch, Huntington Beach, Calif.

[73] Assignee: Apollo Sprayers International, Inc., Fountain Valley, Calif.

[21] Appl. No.: 231,089

[22] Filed: Aug. 24, 1988

[51] Int. Cl.[4] ..... F04B 41/06

[52] U.S. Cl. ..... 417/62; 417/2; 417/244; 417/426

[58] Field of Search ..... 417/244, 234, 2, 426, 417/62, 246, 247; 239/351

[56] References Cited

U.S. PATENT DOCUMENTS

| | | | |
|---|---|---|---|
| 1,533,271 | 4/1925 | Replogle | 15/329 |
| 2,175,641 | 10/1939 | Replogle | 417/247 |
| 2,860,918 | 11/1958 | White et al. | 239/351 |
| 3,255,967 | 6/1966 | Kenny | 239/133 |
| 3,411,673 | 11/1968 | Mann | 222/189 |
| 3,614,267 | 10/1971 | Schultze | 417/206 |
| 3,992,131 | 11/1976 | Masterman et al. | 417/206 |
| 4,120,616 | 10/1978 | Dwyer et al. | 417/373 |
| 4,277,955 | 7/1981 | Parker | 417/426 |
| 4,305,214 | 12/1981 | Hurst | 37/67 |
| 4,659,013 | 4/1987 | Ledebuhr et al. | 239/8 |
| 4,662,826 | 5/1987 | Nitta et al. | 417/206 |
| 4,729,722 | 3/1988 | Toth | 417/234 |
| 4,761,299 | 8/1988 | Hufstetler | 118/629 |

*Primary Examiner*—Carlton R. Croyle
*Assistant Examiner*—D. Scheuermann
*Attorney, Agent, or Firm*—Walter A. Hackler

[57] ABSTRACT

A high volume, low pressure impeller apparatus is provided for the spraying of liquids having a wide range of viscosities. The use of two serially interconnected impeller blowers enables the spraying of both stains and latex paints while still achieving fine sprayed coatings.

15 Claims, 1 Drawing Sheet

FIG. 3.
FIG. 1.
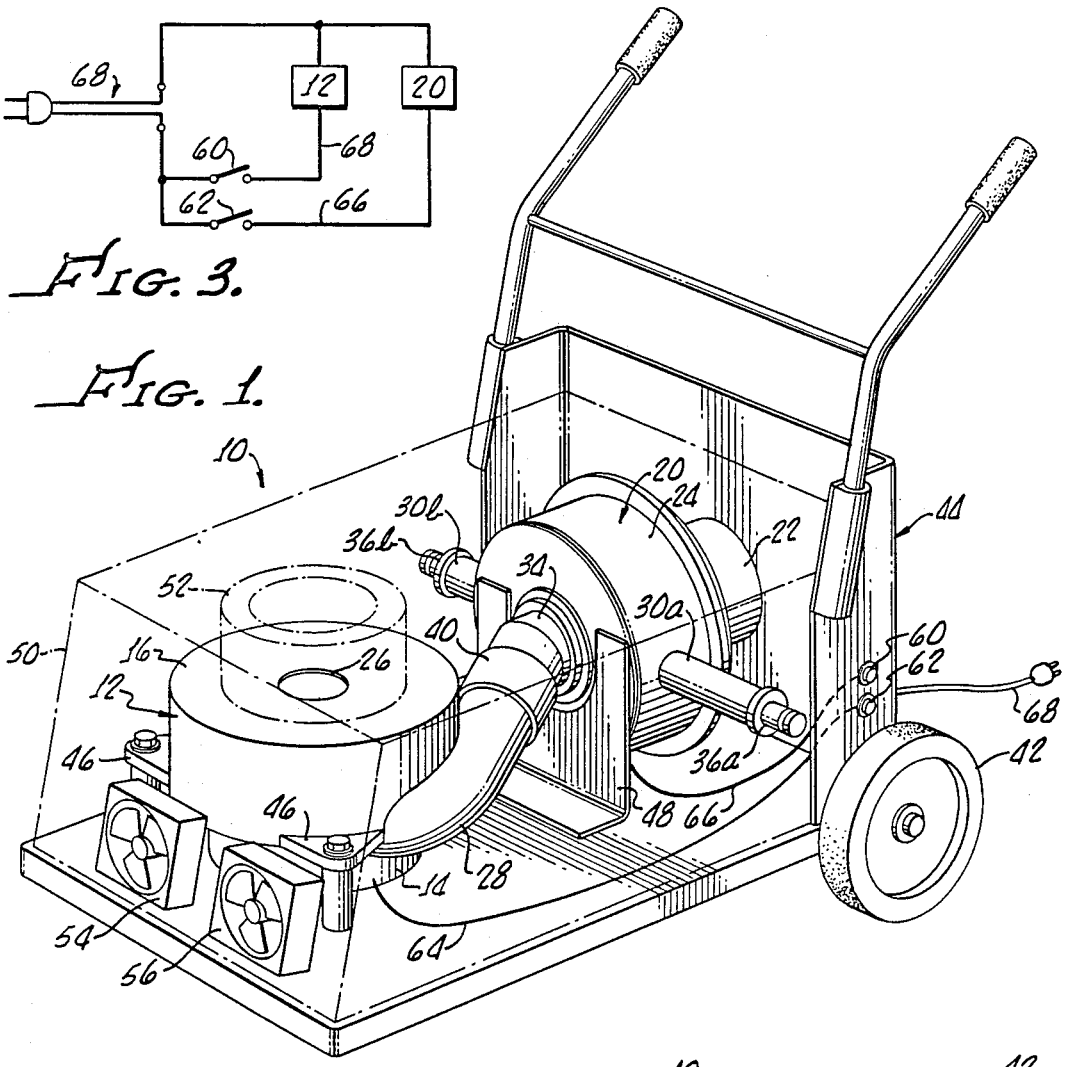
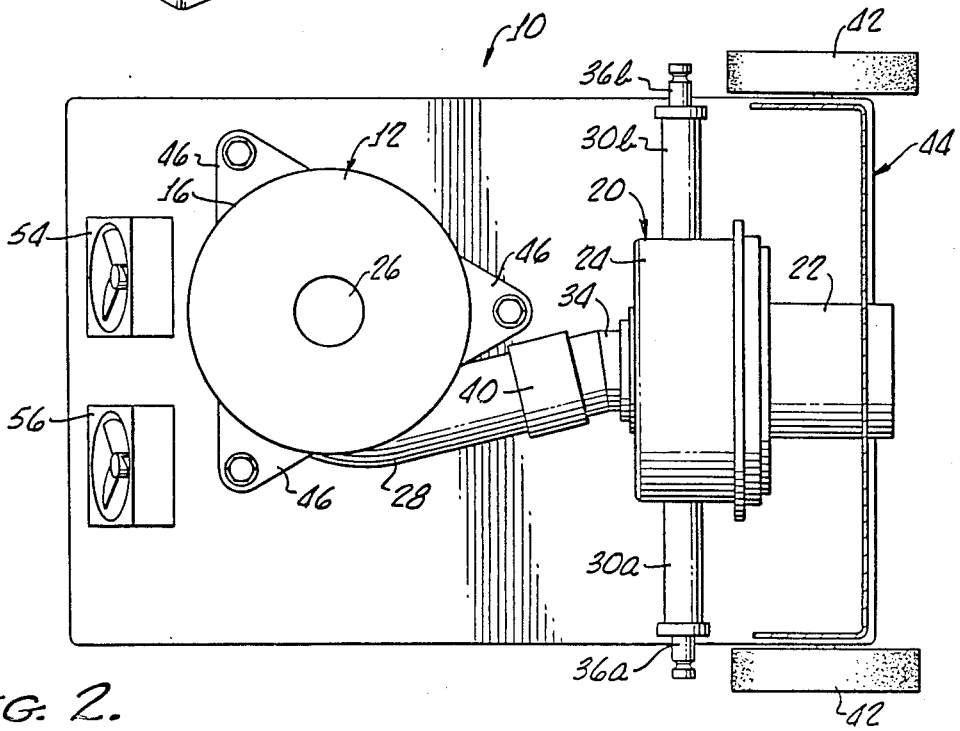
FIG. 2.

SERIES IMPELLER AIR PUMP FOR LIQUID SPRAYER

The present invention generally pertains to equipment, or apparatus, for use in the spraying of liquids and is more particularly directed to high volume, low pressure, impeller apparatus for providing air volume in pressures suitable for the spraying liquids of varied viscosities to a spray gun.

Heretofore, a number of spraying systems have been utilized for the atomization of liquids into a spray and directing that spray onto objects for coating thereof.

A conventional method of spraying utilizes compressed air which is supplied to a nozzle along with a liquid. Contact of the high pressure air and the liquid causes atomization thereof and the escaping air, with atomized particles therein, carries the liquid to its intended target. In this system, high pressure air is utilized, for example, between about 20 psi to about 100 psi. The release of air at this pressure and nozzle causes atomization of a liquid placed on or near its path and because of the high pressures, a very low volume of air is necessary, for example, about 10 cubic feet per minute to carry the liquid.

By adjusting the pressure, almost any coating, paint or material can be successfully sprayed. Unfortunately, because of the high energy discharge of air, the liquid is typically oversprayed. The transfer efficiency of this conventional system is known to be about 25 percent.

The disadvantages of the overspray are high waste, messy operation, which requires continual booth and filter cleaning, and most importantly, pollution of the environment. In addition, because of the high pressures required, oil seals, which are typically utilized in the compressors, may leak and cause contamination of the air with oil.

A more recent development in spraying technology is known as the airless system. This system utilizes a high pressure fluid pump which forces paint through a small orifice in a nozzle head at pressures between 2000 to 3000 psi. As the name applies, no air is utilized in this system and an electric motor typically powers the fluid.

As may be expected, since air is no longer used as a carrier of the atomized liquid, this system is capable of projecting a much larger volume of liquid than a conventional compressed air system. Systems have been known in the construction industry which are capable from spewing up to 30 gallons per hour. The terms "spewing" is used because, while large volumes are emitted from an airless spray gun, the unit literally blasts out paint which results in little control of the gun, a great deal of overspray, and bounce back to the operator. Although thick paint can be sprayed without reducing, and very large areas can be covered quickly, fine finishes, such as lacquer coating of furniture, or automobiles, are almost impossible to achieve. In addition, this equipment can be hazardous because the high pressure paint emission can penetrate an operator's skin if inadvertently directed thereonto.

The present system pertains to a high volume air flow system at ultra low pressures. For example, it has been found that air at one and one half psi, but flowing at about 40 cubic feet per minute, can be used to atomize a liquid. In this instance, it is a large volume of air passing in contact with a liquid in a suitable nozzle which causes the atomization of the liquid.

Because air is emitted at low pressures, better control of the spray pattern is achieved and very little overspray occurs, thus resulting in a cleaner operation and further, causing less pollution to the environment. In terms of transfer efficiency hereinabove measured, the high volume, low pressure systems measure at about 80 percent. Hence, significant savings on paint and materials results.

Heretofore, one problem with sprayers of this types is the lack of versatility of being able to atomize and spray heavy liquids, such as latex paint, thick oil paints, adhesives and catalyzed polyurethanes, or the like. Heretofore, available high volume, low pressure systems have been limited to fine coating finishes and were best utilized in the spraying of lacquers and stains.

The present invention overcomes the disadvantages of prior art, high volume, low pressure type sprayers in its ability to both spray low viscosity liquids and high viscosity liquids, such as latex adhesives, etc.

SUMMARY OF THE INVENTION

In accordance with the present invention, high volume, low pressure impeller apparatus for use in the spraying of liquids, such as stains, paints, coatings, adhesives and latex, generally includes a first motor and a second motor. A first air impeller means, interconnected with the first motor, and having an air inlet and an air outlet, is provided for producing a sufficient volume of air through the air outlet thereof to drive a liquid atomizing spray gun and for enabling air to be freely passed through the first air impeller means from the inlet to the outlet thereof, when the first air impeller means is not driven by the first motor. Because an air impeller is utilized to generate the volumes of air necessary, its free spinning impeller blades, when not driven by the motor, enable the free passage of air therethrough, which is important in the operation of the apparatus as hereinafter described.

Also provided, is second air impeller means, interconnected with a second motor and having an air inlet and an air outlet for producing a sufficient volume of air through the air inlet thereof to drive a liquid atomizing spray gun, and for enabling air to be freely passed through the second air impeller means from the inlet to the outlet thereof when the second impeller means is not driven by the second motor. Hence, the operation of the second impeller means is similar to that of the first impeller means.

Importantly, impellers are utilized instead of a compressor, as in conventional systems. Since impellers are smaller and lighter than compressors, the system is amenable to portable installation and further, impellers produce clean, dry air, uncontaminated by oil or moisture, such as may occur with conventional type compressors.

In accordance with the present invention, conduit means are provided for interconnecting the first impeller means outlet to the second impeller means inlet and control means are provided for selectively causing the first motor to drive the first air impelller means and preventing the second motor from driving the second air impeller means, thus enabling the second air impeller means to freely pass the air from the first air impeller means out through the second air impeller means. Hence, the volume of air produced by the system in this instance is solely attributed to the first air impeller means.

In addition, the control means may selectively cause the second motor to drive the second air impeller means and prevent the first motor from driving the first air impeller means to enable the first air impeller means to freely pass air to the second air impeller means inlet. In this manner, the total volume of air produced by the system is attributed to the second turbine. A variation in the volume of air is provided when the first and second impeller means have different volume capacitites, that is, the volume of air produced by the first air impeller means is greater than the volume of air produced by the second air impeller means.

The control means is further operative for selectively causing both the first motor to drive the first air impeller means and the second motor to drive the second air impeller means. In this mode of operation, the volume of air produced by this system is a combination of the output of the first and second air impeller means and in this mode of operation enables the apparatus in accordance with the present invention, when used in combination with a spray gun, to satisfactorily spray heavy liquids, such as latex, while still achieving a fine spray coat.

More specifically, the first air impeller means in the present invention may be configured for producing air at up to about 130 cubic feet per minute at about 6 psi, when ambient air is taken through the inlet thereof, and the second air impeller means is configured for producing air at up to about 90 cubic feet per second at about 3 psi, in order to cause an output of air at about 200 cubic feet per minute at about 10 psi when both first and second impeller means are selectively driven by the control means.

The first air impeller means may have an air outlet which provides a tangential discharge of air and mounting menas may be provided for supporting the first air impeller means in a position, such that tangential, discharge of air is along a horizontal plane and wherein the second air impeller means air inlet is axially disposed and coupled to the first impeller means air outlet along the horizontal discharge plane of the first impeller means air outlet. This feature enables a very close coupling of the two impellers which facilitates its mounting on a portable cart. In order to provide convenience of use and use by more than one operator, the second air impeller means may include a first and a second air outlet one being disposed on each of opposite sides of the second air impeller. In order to enable independent operation of these outlets, valve means may be provided for controlling the use of one or both of the second air impeller means outlets.

It is important to note that while the first motor driven air impeller and the second motor driven air impeller are interconnected in a serial manner, with the output from the first air impeller means being connected to an inlet of the second air impeller means, they can be operated in an independent fashion because the impeller configuration thereof enables air to freely pass through one of the impellers while the other one is being driven. When both are driven, the second impeller means provides an additional amplification of both the volume of air and air pressure in order to achieve air volumes and pressures suitable for spraying viscous liquids as hereinafter described.

Since the control means is operative for selectively driving either the first or second air impeller means, singly and in combination, it effectuates the providing of air at proper volumes and pressures in order for a liquid atomizing sprayer to spray liquids having a viscosity between about 14 second to about 60 seconds, measurements being made with a No. 2 Zahn Cup.

DESCRIPTION OF THE DRAWINGS

The advantages and features of the present invention will be better understood by the following description and drawings, in which:

FIG. 1 is a perspective view of the present invention, generally showing a first and a second impeller means disposed on a portable cart and interconnected with a control system;

FIG. 2 is a plan view of the present invention generally showing the layout of the two air impellers; and FIG. 3 is a schematic drawing of the control system of the present invention.

DETAILED DESCRIPTION

Turning to FIGS. 1 and 2, there is shown a high volume, low pressure impeller apparatus 10, in accordance with the present invention, which generally includes a first motor driven air impeller 12 having a motor 14 and a impeller 16 and a second motor driven air impeller 20 including a motor 22 interconnected with a impeller 24.

As hereinafter discussed in greater detail, the impeller 16 includes an air inlet 26 and an air outlet 28 and provides means when driven by the motor 14 for producing a sufficient volume of air through the air outlet thereof to drive a liquid atomizing spray gun (not shown) and importantly for enabling air to be freely passed through the first impeller 16 from the inlet 26 to the outlet 28 thereof when the first air impeller 16 is not driven by the first motor 14.

The second air impeller 24, when driven by the second motor 22, provides means for producing a sufficient volume of air through outlets **30*a* and 30*b* to drive a liquid atomizing spray gun (not shown) and for enabling air to be freely passed through the second air impeller 24 from the inlet 34 to the outlets 30*a*, 30*b* and, when the motor 22 is not driving the impeller 24, the impeller 24 enables air to be freely passed through the second air impeller 24 from the inlet 34 to the outlet 30*a*, 30*b***.

It should be appreciated that each of the outlets **30*a*, 30*b* may be fitted with quick coupling valves 36*a*, 36*b*, to enable air to be withdrawn from either side of the impeller 24** or simultaneously if more than one spray gun (not shown) is utilized.

The spray guns referred to and interconnecting hoses (not shown) are not part of the present invention, but are specifically designed for high volume, low pressure spraying apparatus. A typical spray gun may be a model ASG 100 cup-type gun available from Apollo Sprayers International, Inc., of Fountain Valley, Calif.

Many suitble motor driven turbines may be utilized, for example, the first motor driven impeller 12 may be a LAMB®, Model 116119-00, available from Ametek Lamb Electric Division of Kent, Ohio, which is a 3-stage, 3-speed by-pass 7.2 inch diameter 120 Volt, double ball bearing unit. The second motor driven impeller may also be a LAMB®, specifically Model 115757-P or 116336 available from Ametek, which is a 2-stage, single speed, by-pass 5.7 diameter, 120 Volt, one ball-/one sleeve bearing unit.

It must be appreciated that any suitable impeller may be utilized as long as it is of the free wheeling type, that is, when it is not driven by a motor, the turbine is free to allow air to pass therethrough. This feature enables the serial interconnection of the first motor driven turbine 12 with the second motor driven impeller 20 in order to utilize each of the turbines individually or in combination.

Specifically, for the motor driven impellers 12, 20, set forth, when the first air driven impeller 12 is being motor driven and the second motor driven impeller is not, the output of air through the outlets 36*a*, 36*b*, of the second impeller, is about 130 cubic feet per minute at about 6 psi.

When the second motor driven impeller 20 is driven by the motor 22 and the first impeller 16 is not driven and allowed free to pass air therethrough, the output at the outlet 36*a*, 36*b* of the second impeller is about 90 cubic feet per minute at about 3 psi. When both impellers 16, 24 are driven respectively by motors 14, 22, the output at the outlet 30*a*, 30*b*, is about 200 cubic feet and at about 100 psi. The outlet 28 is coupled to the inlet 34 by means of a conduit 40 and because the first air impeller 16 includes a tangential discharge of air through the outlet 28, the first motor driven impeller 12 and the second motor driven impeller 20 may be mounted to a wheeled 42 cart 44 and brackets 46, 48 provide means for mounting, or supporting the first air impeller 12 in a position such that the tangential discharge of air is along a horizontal plane and wherein the second air impeller 20, inlet 34 is axially disposed therein and coupled to the first impeller 16 outlet 28 by means of the conduit 40 along the horizontal discharge plane of the first impeller outlet 28.

Because of this arrangement, compact mounting and intercoupling of the first and second motor driven impellers 12, 20 is enabled thereby facilitating the portability of the unit. The first and second motor driven impellers 12, 20 may be enclosed by a protective housing 50 to prevent dirt, paint, and the like, from gathering on surface areas thereof and an air filter 52 may be provided around the inlet 26 in a conventional manner to prevent the intake of particulates which may contaminate the outlet air from the assembly 10. When the housing 50 is provided, motor driven fans 54, 56 may be utilized in order to pass cooling air over the impellers 12, 20.

As hereinbefore pointed out with regard to the specified first and second motor driven impellers 12, 20, the first motor driven impeller may have a larger capacity than the second motor driven impeller in order that the volume produced by the first air impeller is greater than the volume of air produced by the second air impeller. This feature enables a wider range of air volume and pressure output than if the impellers were of equal size. Operationally, equal sized impellers (not shown) could be utilized.

Switches 60, 62 and interconnecting wires 64 66, to the first motor driven impeller 12 and the second motor driven impeller 20, respectively, along with a power cord 68 interconnected to the switches, as schematically shown in FIG. 3, provide means for selectively causing the first motor 14 to drive the first air impeller 16 and preventing the second motor 22 from driving the second air impeller 20 thus enabling the second air impeller means to freely pass the air from the first air impeller means outlet through the second air impeller 20. Alternatively, the switches 60, 62 may be set for causing the second motor 22 to drive the second impeller 20, while preventing the first motor 14 from driving the first impeller 16. In this instance, as hereinbefore pointed out, air is freely drawn through the first impeller 16. Finally, both switches may activate motors 14 and 22 for simultaneously driving the first and the second impellers 16, 20.

Specific performance of the present invention is shown in Table 1 which show the viscosity of liquids sprayable utilizing the smaller second impeller 20 only, the larger first impeller only and the combination of both impellers. It can be easily appreciated that the apparatus 10 provides means for spraying liquids with viscosities from about 14 seconds to about 60 seconds. This is not possible using a single impeller, simply because, for example, the large first impeller 16, in producing 130 cubic feet per minute of air at 6 psi, is not suitable for spraying thin coatings having a viscosity of less than about 20 seconds measured with a #2 Zahn Cup.

TABLE 1

VARIOUS COATINGS AND THE IMPELLER COMBINATION UTILIZED IN ORDER TO SPRAY THEM AND ACHIEVE A FINE FINISH

| | #2 Zahn Cup |
|---|---|
| Small Impeller Only 3 P.S.I.; 90 CFM | |
| Solvent Based Stains | 14 Seconds |
| Teak Oils | 17 Seconds |
| Water Based Stains | 12 Seconds |
| Release Agents | 15 Seconds |
| Lacquers | 17 Seconds |
| All Other Thin Coatings Below | 19 Seconds |
| Large Impeller Only 6 P.S.I.; 130 CFM | |
| Water Soluble Coatings | 25 Seconds |
| Solvent Enamels | 25 Seconds |
| Acrylic Enamels (Auto Finishing) | 14 Seconds |
| Oil Based Paints | 28 Seconds |
| Polyurethane Paints | 28 Seconds |
| Primers Oil and Solvent | 27 Seconds |
| Rust Inhibitors | 25 Seconds |
| All Coatings of the Viscosity Range | 20–30 Seconds |
| Both Impelles 10 P.S.I.; 20 CFM | |
| Latex Paints | 40 Seconds |
| Thick Oil Paints | 40 Seconds |
| Adhesives (Spraying) | 50 Seconds |
| Catalyzed Polyurethanes | 45 Seconds |
| ** Automotive Catalyzed Polyurethanes (Imron) | 19 Seconds |
| All Heavy Sprayable Materials | 30–60 Seconds |

** Special high power required to give a "mirror" finish.

Although there has been described hereinabove a specific apparatus for use in the spraying of liquids, such as stains, paints, coatings, adhesives and latex, for the purpose of illustrating the manner in which the present invention may be used to advantage, it should be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. High volume, low pressure impeller apparatus for use in the spraying of liquids such as stains, paints, coatings, adhesives and latex, said apparatus comprising:

a first motor;

a second motor;

first air impeller means, interconnected with said first motor and having an air inlet an an air outlet, for producing a sufficient volume of air through the air outlet thereof to drive a liquid atomizing spray gun and for enabling air to be freely passed through the first air impeller means from the inlet to the outlet thereof when the first air means is not driven by the first motor;

second air impeller means, interconnected with said second motor and having an air inlet and an air outlet, for producing a sufficient volume of air through the air oulet thereof to drive a liquid atomizing spray gun and for enabling air to be freely passed through the second air impeller means from the inlet to the outlet thereof when the second air impeller means is not driven by the second motor;

conduit means for interconnecting the first impeller means outlet to the second impeller means inlet; and control means for selectively causing the first motor to drive the first air impeller means and preventing the second motor from driving the second air impeller means thus enabling the second air impeller means to freely pass the air from the first air impeller means outlet through the second air impeller means, causing the second motor to drive the second air impeller means and preventing the first motor from driving the first air impeller means thus enabling the first air impeller means to freely pass air to the second air impeller means inlet, and causing the first motor to drive the first air impeller means and the second motor to drive the second air impeller means.

2. The apparatus according to claim 1 wherein the volume of air produced by the first air impeller means is greater than the volume of air produced by the second air impeller means.

3. The apparatus according to claim 1 wherein the first air impeller is configured for producing air at up to about 130 cubic feet per minute at about 6 psi when ambient air is taken through the inlet thereof, and the second air impeller means is configured for producing air at up to about 90 cubic feet per minute at about 3 psi, in order to cause an output of air at about 200 cubic feet per minute at about 10 psi when both the first and second impeller means are driven.

4. The apparatus according to claim 3 wherein said first air impeller means air outlet provides a tangential discharge of air and further including mounting means for supporting said first air impeller means in a position such that the tangential discharge of air is along a horizontal plane and wherein said second air impeller means air inlet is axially disposed therein and coupled to the first impeller means air outlet along the horizontal discharge plane of the first impeller means air outlet.

5. The apparatus of claim 4 further comprising a portable cart for supporting the interconnected first and second impeller means and wherein said second air impeller means comprises a first and a second air outlet, one being disposed on each of opposite sides of said second air turbine, said second air impeller means first and second outlets comprising valve means for enabling the first and second outlet to independently supply air to a liquid atomizer spray gun.

6. High volume, low pressure impeller apparatus for use in the spraying of liquids such as stains, paints, coatings, adhesives and latex, said apparatus comprising:

first motor drive air impeller means for producing a sufficient volume of air to drive a liquid atomizing spray gun;

second motor driven air impeller means for producing a sufficient volume of air to drive a liquid atomizing spray gun;

said first and second air impeller means being interconnected in a serial manner with an output from the first air impeller means being connected to an inlet of the second air impeller means; and power control means for selectively providing power to the first motor driven air impeller means, the second motor driven air impeller means and both the first and second motor drive air impeller means.

7. The apparatus according to claim 6 wherein the volume of air produced by the first motor driven air impeller is greater than the volume of air produced by the second motor driven air impeller.

8. The apparatus according to claim 7 wherein the first motor driven air impeller means is configured for producing air at up to about 130 cubic feet per minute at about 6 psi, when ambient air is taken through the inlet thereof, and the second motor driven air impeller means is configured for producing air at up to about 90 cubic feet per minute at about 3 psi, in order to cause an output of air at about 200 cubic feet per minute at about 10 psi when both the first and second impeller means are driven.

9. The apparatus according to claim 8 wherein said first motor driven air impeller means air outlet provides a tangential discharge of air and further including mounting means for supporting said first motor driven air impeller means in a position such that the tangential discharge of air is along a horizontal plane and wherein said second motor driven air impeller means air inlet is axially disposed therein and coupled to the first motor driven air impeller means air outlet along the horizontal discharge plane of the first impeller means air outlet.

10. The apparatus of claim 9 further comprises a portable cart for supporting the interconnected first and second motor driven air impeller means and wherein said second motor driven air impeller means comprises a first and a second air outlet, one being disposed on each of opposite sides of said second motor driven air impeller, said second motor driven air turbine means first and second outlets comprising valve means for enabling the first and second outlet to independently supply air to a liquid atomizer spray gun.

11. High volume, low pressure impeller apparatus for use in the spraying of liquids such as stains, paints, coatings, adhesives and latex, said apparatus comprising:

first motor drive air impeller means for producing a sufficient volume of air to drive a liquid atomizing spray gun;

second motor driven air impeller means for producing a sufficient volume of air to drive a liquid atomizing spray gun;

said first and second air impeller means being interconnected in a serial manner with an output from the first air impeller means being connected to an inlet of the second air impeller means; and control means for enabling the first and second motor driven air, impeller singly and in combination, to provide air at proper volume and pressure in order for a liquid atomizer sprayer to spray liquids having a viscosity of between about 14 seconds (#2 Zahn Cup) to abut 60 seconds (#2 Zahn Cup).

12. The apparatus according to claim 11 wherein the volume of air produced by the first motor driven air impeller is greater than the volume of air produced by the second motor driven air impeller.

13. The apparatus according to claim 11 wherein the first motor driven impeller means is configured for producing air at up to about 130 cubic feet per minute at about 6 psi, when ambient air is taken through the inlet thereof, and the second motor driven air impeller means is configured for producing air at up to about 90 cubic feet per minute at about 3 psi, in order to cause an output of air at about 200 cubic feet per minute at about 10 psi when both the first and second impeller means are driven.

14. The apparatus according to claim 13 wherein said first motor drive air impeller means air outlet provides a tangential discharge of air and further including mounting means for supporting said first air impeller means in a position such that the tangential discharge of air is along a horizontal plane and wherein said second motor driven air impeller means air inlet is axially disposed therein and coupled to the first motor driven air impeller means air outlet along the horizontal discharge plane of the first impeller means air outlet.

15. The apparatus of claim 14 further comprises a portable cart for supporting the interconnected first and second motor driven air impeller means and wherein said second motor driven air impeller means comprises a first and a second air outlet, one being disposed on each of opposite sides of said second motor driven air impeller, said second motor driven air impeller means first and second outlets comprising valve means for enabling the first and second outlet to independently supply air to a liquid atomizer spray gun.

* * * * *